US010501996B2

(12) United States Patent
Mageren et al.

(10) Patent No.: US 10,501,996 B2
(45) Date of Patent: Dec. 10, 2019

(54) WELLBORE TOOL REAMER ASSEMBLY

(71) Applicant: Halliburton Energy Services, Inc., Houston, TX (US)

(72) Inventors: Olivier Mageren, Jette (BE); Philippe Fanuel, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 121 days.

(21) Appl. No.: 15/541,143

(22) PCT Filed: Dec. 30, 2014

(86) PCT No.: PCT/US2014/072731
§ 371 (c)(1),
(2) Date: Jun. 30, 2017

(87) PCT Pub. No.: WO2016/108837
PCT Pub. Date: Jul. 7, 2016

(65) Prior Publication Data

US 2017/0350194 A1 Dec. 7, 2017

(51) Int. Cl.
*E21B 10/32* (2006.01)
*E21B 10/34* (2006.01)

(52) U.S. Cl.
CPC ..... *E21B 10/345* (2013.01); *E21B 10/322* (2013.01)

(58) Field of Classification Search
CPC ..... E21B 10/345; E21B 10/322
USPC ..... 175/57
See application file for complete search history.

(56) References Cited

U.S. PATENT DOCUMENTS

| | | | | |
|---|---|---|---|---|
| 1,375,094 | A * | 4/1921 | Humason | E21B 10/28 175/334 |
| 2,684,120 | A | 7/1954 | Brown | |
| 4,798,246 | A | 1/1989 | Best | |
| 4,904,119 | A | 2/1990 | Legendre et al. | |
| 6,732,817 | B2 | 5/2004 | Dewey et al. | |
| 6,991,046 | B2 | 1/2006 | Fielder et al. | |
| 7,100,713 | B2 | 9/2006 | Tulloch | |
| 7,108,082 | B1 | 9/2006 | Anthony et al. | |
| 7,152,702 | B1 | 12/2006 | Bhome et al. | |
| 7,350,596 | B1 | 4/2008 | Attaya | |
| 7,588,101 | B2 | 9/2009 | Lynde et al. | |
| 8,141,628 | B2 | 3/2012 | Hart | |
| 8,191,416 | B2 | 6/2012 | Kuchuk et al. | |
| 8,297,381 | B2 | 10/2012 | Radford et al. | |
| 8,347,989 | B2 | 1/2013 | Buske et al. | |

(Continued)

FOREIGN PATENT DOCUMENTS

WO 2016108837 A1 7/2016

*Primary Examiner* — Taras P Bemko
(74) *Attorney, Agent, or Firm* — Alan Bryson; Parker Justiss, P.C.

(57) ABSTRACT

A wellbore reamer assembly positionable on a drill string in a wellbore includes a reamer body having an internal cavity and multiple radial openings, multiple cutting structures each positioned in one of the radial openings in the reamer body, and a fluid-activated expandable support element positioned in the internal cavity of the reamer body adjacent the cutting structures. The cutting structures are extendable radially away from a central longitudinal axis of the reamer body through respective radial openings and retractable toward the central longitudinal axis of the reamer body.

19 Claims, 9 Drawing Sheets

(56) References Cited

U.S. PATENT DOCUMENTS

| | | | | |
|---|---|---|---|---|
| 2008/0271892 | A1* | 11/2008 | Lynde | E21B 29/005 166/298 |
| 2012/0193147 | A1 | 8/2012 | Hall et al. | |
| 2012/0298423 | A1 | 11/2012 | Cruickshank et al. | |
| 2013/0248252 | A1* | 9/2013 | Oesterberg | E21B 10/32 175/57 |
| 2013/0292175 | A1 | 11/2013 | Radford et al. | |
| 2014/0353032 | A1 | 12/2014 | Radford et al. | |

* cited by examiner

WELLBORE TOOL REAMER ASSEMBLY

CROSS-REFERENCE TO RELATED APPLICATION

This application is the National Stage of, and therefore claims the benefit of, International Application No. PCT/US2014/072731 filed on Dec. 30, 2014, entitled "WELLBORE TOOL REAMER ASSEMBLY," which was published in English under International Publication Number WO 2016/108837 on Jul. 7, 2016. The above application is commonly assigned with this National Stage application and is incorporated herein by reference in its entirety.

BACKGROUND

The present disclosure relates to tools for drilling a wellbore in a formation, and more particularly to a wellbore reamer assembly for expanding a wellbore diameter.

A wellbore reamer is used to enlarge the diameter of a wellbore drilled through a subsurface formation by rotation of the reamer about a longitudinal axis of a drill string. A wellbore reamer generally includes cutting structures, such as cutter blocks or blades, used to enlarge the wellbore in a subterranean formation by shearing, crushing, cracking, or a combination of shearing, crushing, and cracking wellbore walls of the formation during rotation of the drill string. Cutting structures of a reamer are often positioned in a wellbore on a drill string at a radially retracted position, such as when the drill string and included reamer are run down the wellbore. With the reamer positioned at a desired location within the wellbore, the movable cutting structures are activated to a radially extended position to engage a wellbore wall. The reamer is then rotated with the cutting structures in the radially extended position to enlarge the diameter of the wellbore previously drilled through the formation.

DESCRIPTION OF DRAWINGS

Like reference symbols in the various drawings indicate like elements.

DETAILED DESCRIPTION

Figure 1:
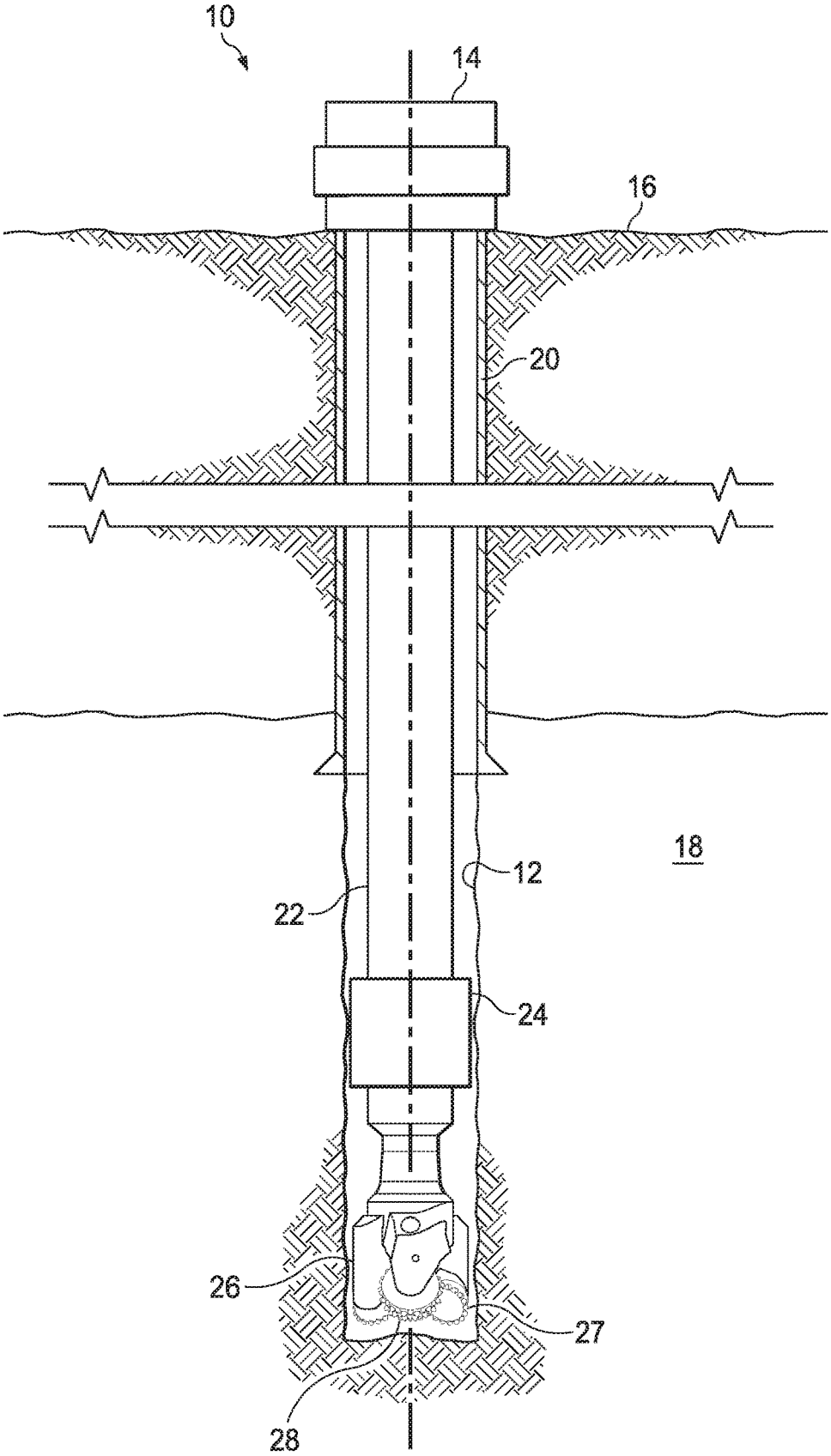
FIG. 1 is a schematic partial cross-sectional elevation view of an example well system.

FIG. 1 is a schematic partial cross-sectional elevation view of a well system 10 that generally includes a generally cylindrical wellbore 12 extending from a wellhead 14 at the surface 16 downward into the Earth into one or more subterranean zones of interest (one subterranean zone of interest 18 shown). The subterranean zone 18 can correspond to a single formation, a portion of a formation, or more than one formation accessed by the well system 10, and a given well system 10 can access one, or more than one, subterranean zone 18. After some or all of the wellbore 12 is drilled, a portion of the wellbore 12 extending from the wellhead 14 to the subterranean zone 18 is lined with lengths of casing 20. The depicted well system 10 is a vertical well, with the wellbore 12 extending substantially vertically from the surface 16 to the subterranean zone 18. The concepts herein, however, are applicable to many other different configurations of wells, including horizontal, slanted or otherwise deviated wells, and multilateral wells with legs deviating from an entry well.

A drill string 22 is shown as having been lowered from the surface 16 into the wellbore 12. The drill string 22 may be a series of jointed lengths of drill pipe coupled together end-to-end and/or a continuous (i.e., not jointed) coiled tubing. The drill string 22 includes one or more well tools, including a wellbore reamer tool 24 and a drill bit 26. As illustrated, the drill bit 26 may include cutting structures comprising cutters affixed to a roller disc 27, or cutting teeth affixed to a roller cone 28, among others. The wellbore 12 can be drilled in stages, and the casing 20 may be installed between stages.

Figure 2:
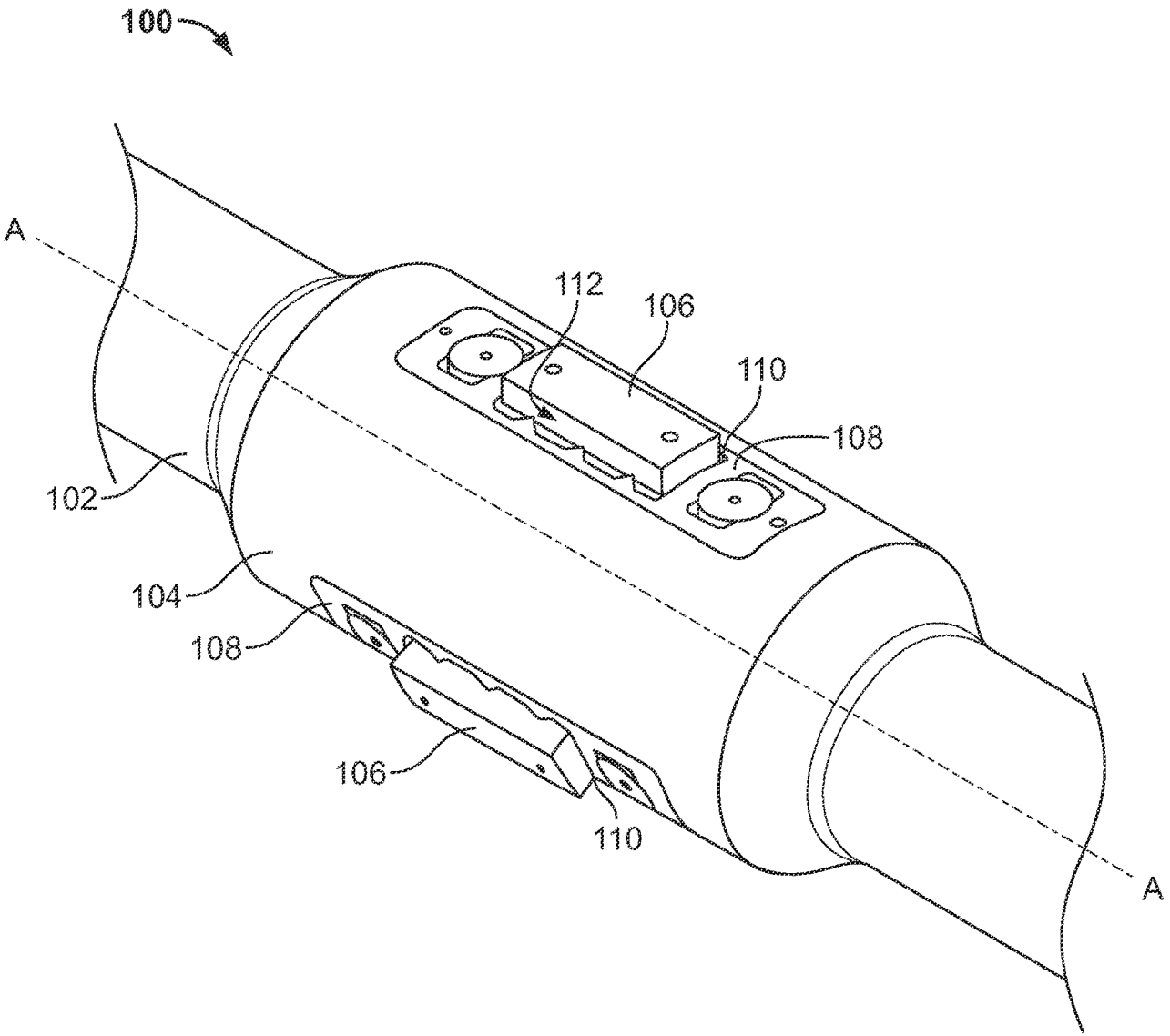
FIG. 2 is a schematic perspective view of an example wellbore reamer assembly.

FIG. 2 is a schematic perspective view of an example wellbore reamer assembly 100 that can be used as the wellbore reamer tool 24 of FIG. 1. The example reamer assembly 100 is carried on a drill string 102 (e.g., drill string 22 of FIG. 1) and includes a central axis A-A, a reamer body 104 coupled to the drill string 102 and including an outer surface and an internal cavity, and multiple cutting structures 106 (two shown) extending radially from the reamer body 104 and positioned in flanges 108 within openings 110 (e.g., radial openings) in the reamer body 104. The reamer body 104 is generally cylindrical, and the central axis A-A defines a central longitudinal axis along a length of and through the center of the reamer assembly 100 (e.g., through the center of the reamer body 104). The reamer assembly 100 is rotated about the central axis A-A and moved up and/or down while rotating to enlarge the diameter of the wellbore hole previously drilled by drill bit 26 of FIG. 1. The central axis A-A may define a rotational axis of the reamer assembly 100, for example, during operation of the reamer assembly 100. The cutting structures 106 are extendable radially away from the central axis A-A through the radial openings 110 and retractable toward the central axis A-A. The cutting structures 106 are radially supported by a fluid-activated expandable support element (as further described below in relation to FIGS. 3A and 3B) positioned in the internal cavity of the reamer body 104 to move the cutting structures 106 from a radially retracted position to a radially extended position. The radially extended position can correlate to the cutting structures 106 being engaged with a radial wall of the wellbore. If desired, each of the cutting structures 106 may be longitudinally and laterally supported by a respective flange 108 within the reamer body 104 to guide the respective cutting structure 106 as the cutting structure 106 moves between the radially retracted position and the radially extended position. The wellbore reamer assembly 100 may move longitudinally (e.g., along central axis A-A) in the wellbore while rotating the drill string 102 with the cutting structures 106 in the radially extended position to enlarge the diameter of the wellbore hole along longitudinal directions of the wellbore. The expandable support element contacts the cutting structures 106 on a radially inward end of the cutting structures 106, for example, distal to a cutting element (e.g., cutting edge) of the cutting structures 106.

FIG. 2 shows the cutting structure 106 as a substantially rectangular cutter block with a cutting element (e.g., cutting edge 112) at a radially outward end of the cutting structure 106. If desired, while the cutting structure 106 is in the radially extended position, the cutting element (e.g., cutting edge) may shear against walls of a wellbore to enlarge the diameter of the wellbore during rotation of the reamer assembly about central axis A-A. A longer longitudinal length of the cutting structure 106 may allow for a longer lifetime of the cutting structure 106, and therefore a longer lifetime of the reamer assembly 100. The cutting structure 106 can include additional or different components and features than depicted in FIG. 2. The cutting structure 106 may be a different shape and/or include other cutting elements. For example, the cutting structure 106 can include a blade with individual cutters (e.g., PDC cutter inserts, diamond insert cutters, hard-faced metal inserts, and/or others) affixed to the blade. The cutting structure 106 may include cutters and/or cutting teeth affixed to a roller disc and/or cone. The example reamer assembly 100 of FIG. 2 includes three cutting structures 106 (two shown) evenly spaced around the reamer body 104 about the central axis A-A. However, the example reamer assembly 100 can include one, two, or four or more cutting structures 106 spaced, evenly or unevenly, about the reamer body 104.

Figure 3B:
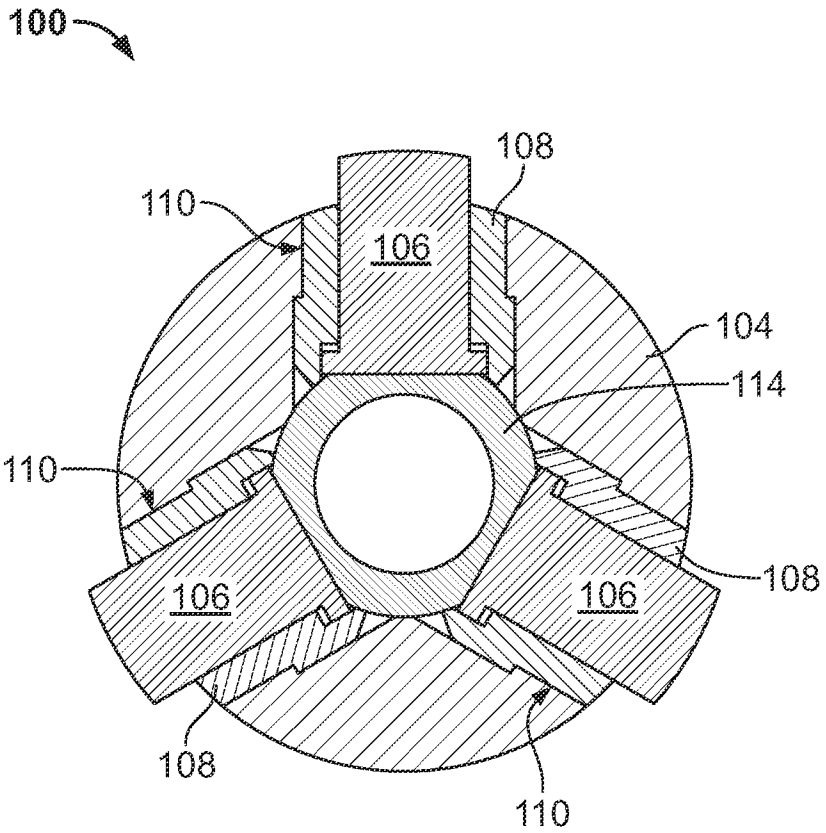
FIGS. 3A and 3B are schematic cross-sectional transverse views of an example wellbore reamer assembly in an inactivated retracted position and an activated extended position, respectively.
Figure 3A:
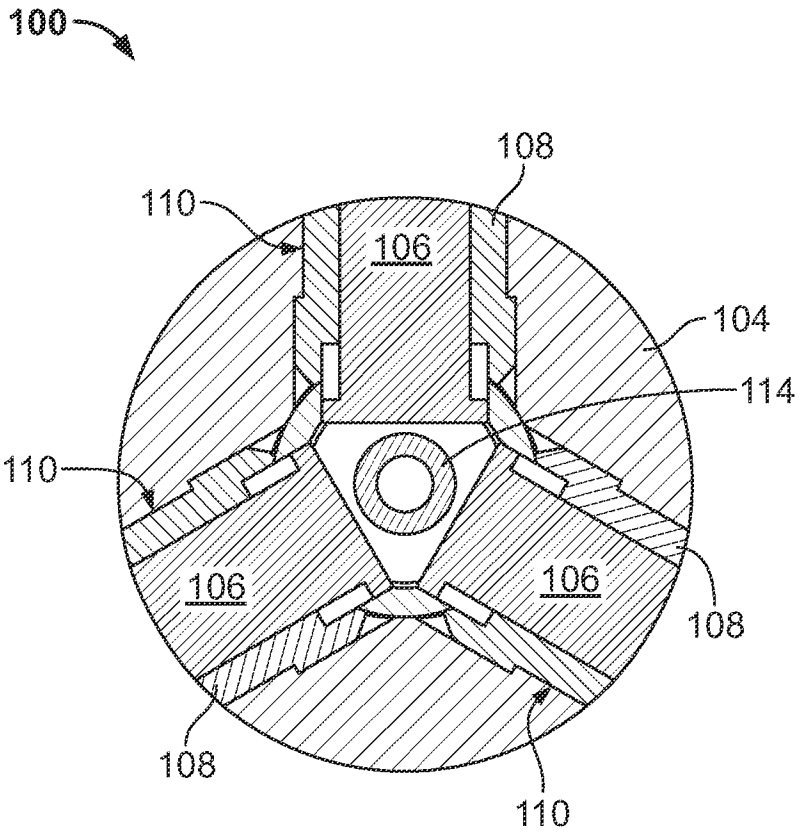
Figure 4A:
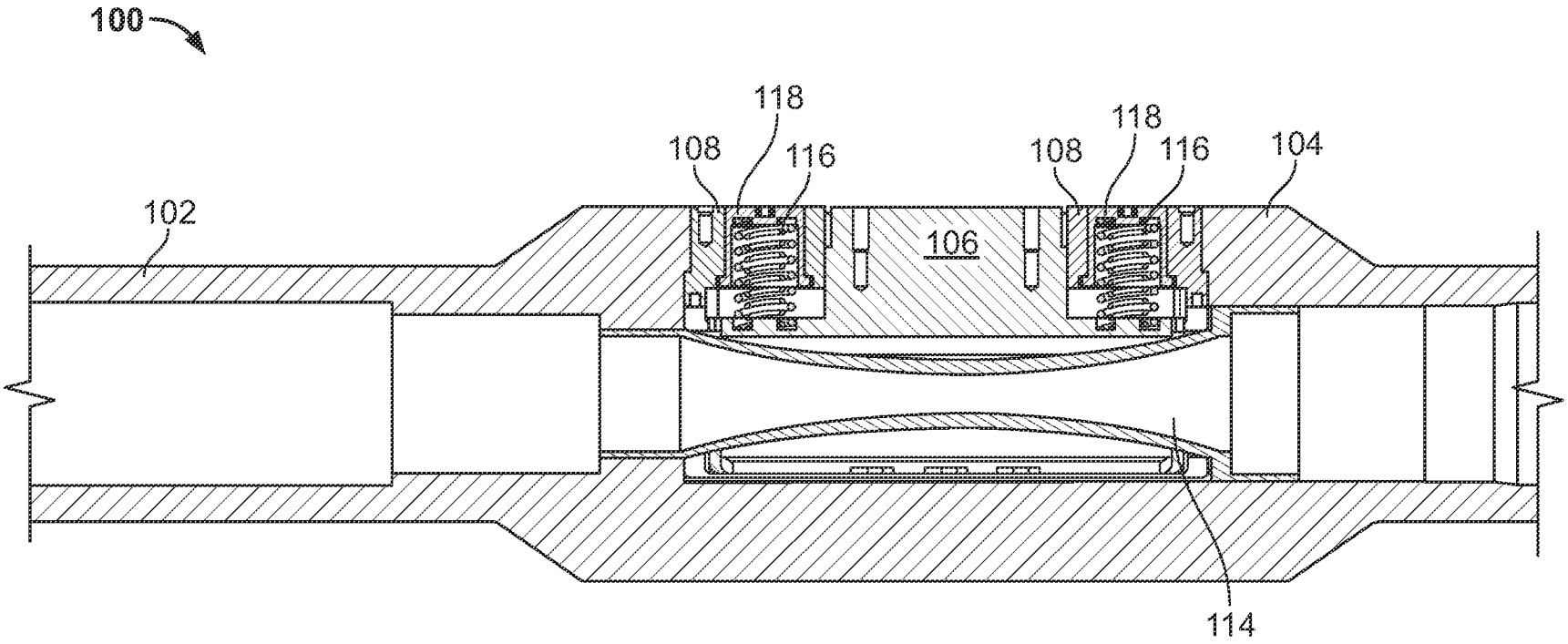
FIGS. 4A and 4B are schematic cross-sectional side views of the example wellbore reamer assembly of FIGS. 3A and 3B in an inactivated retracted position and an activated extended position, respectively.
Figure 4B:
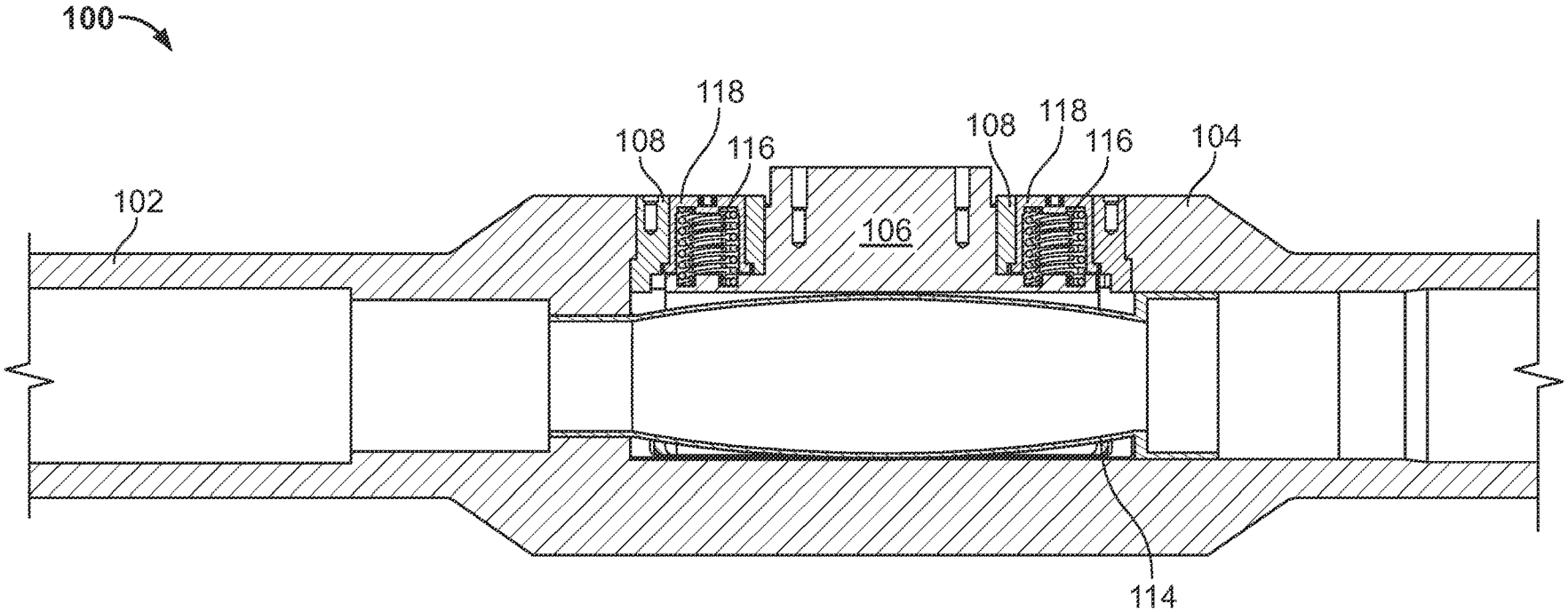

FIGS. 3A and 3B are schematic cross-sectional transverse views of the example reamer assembly 100 with the cutting structure 106 in the radially retracted position (FIG. 3A) and the radially extended position (FIG. 3B). FIGS. 4A and 4B are schematic cross-sectional side views of the example reamer assembly 100 corresponding to FIGS. 3A and 3B, respectively. The radially retracted position of the cutting structure 106 shown in FIGS. 3A and 4A correlates to an inactivated state of the expandable support element 114. The radially extended position of the cutting structure 106 shown in FIGS. 3B and 4B correlates to an activated state of the fluid-activated expandable support element 114. The expandable support element 114 activates (e.g., expands) to substantially fill the internal cavity of the reamer body 104 to push the cutting structures 106 radially outward through the openings 110 in the outer surface of the reamer body 104. For example, the expandable support element 114 is positioned adjacent a radially inward end of the cutting structures 106 (e.g., the ends opposite the cutting element), such that activation of the expandable support element 114 pushes against the radially inward ends of the cutting structures 106. The cutting structure 106 and/or the expandable support element 114 may seal (substantially or wholly) the openings 110 and/or flanges 108 from fluid infiltration into the internal cavity of the reamer body 104, for example, to avoid washout of the reamer assembly 100. For example, FIGS. 3A, 3B, 4A, and 4B show the cutting structures 106 as substantially sealing the flanges 108 in the openings 110 of the reamer body 104. The fluid-activated expandable support element 114 may expand and seal the flanges 108 in the openings 110 in response to fluid being introduced to the fluid-activated expandable support element 114, while the expandable support element 114 supports the cutting structures 106 in the radially extended position. The expandable support element 114 can take a variety of forms. The expandable support element 114 may include an inflatable bladder that expands by fluid supplied to the bladder, for example, to fill the bladder. The bladder may be formed from a polymeric material. If desired, the expandable support element 114 may include a swellable material, for example, a swellable rubber. The expandable support element 114 can be activated (e.g., expanded, radially extended, swelled, and/or other) in a variety of ways. The expandable support element 114 may be pressure actuated, for example, with a dropped ball and ball seat, and/or by a differential pressure between a pressure internal to the reamer assembly and an annulus pressure exterior to the reamer assembly. For example, a pressure internal to the reamer assembly may be applied by a drilling fluid supply being pumped through the drill string 102 and against the expandable support element 114 at a specified pressure, and an annulus pressure may be applied by return fluid through the annulus and against the cutting structures 106. The expandable support element 114 may swell in the presence of an activation component carried in a fluid, for example, that is provided to the internal cavity of the reamer body 104 through a flow port in the reamer body 104. The activation component may cause the expandable support element 114 to activate by swelling in the presence of the activation component. The expandable support element 114 may activate in response to a signal transmitted down the drill string to the wellbore reamer assembly 100 that triggers an activation of the support element 114, such as a hydraulic and/or mechanical expansion of the support element 114, for example, by a dropped magnetic activator, acoustic signal, electrical signal, and/or other. The expandable support element 114 may activate (e.g., expand) when an activation component carried in a fluid through the wellbore reamer assembly 100 triggers an activation sensor in the reamer body 104, for example, coupled to the expandable support element 114.

If desired, such as depicted in FIGS. 4A and 4B, the example reamer assembly 100 may include a spring 116 between the flange 108 and the corresponding cutting structure 106 to bias the cutting structure 106 toward the radially retracted position of FIG. 4A. A spring cap 118 within the flange 108 may house an end of the spring 116 and orient the spring 116 against the cutting structure 106. Activation of the expandable support element 114 applies an outward radial force against the cutting structure 106 that is greater than a radial spring force against the cutting structure 106. For example, activation of the expandable support element 114 overcomes the spring force of the spring 116 biasing the cutting structure 106 toward the radially retracted position, and moves the cutting structure 106 towards the radially extended position of FIG. 4B. Although FIGS. 4A and 4B show two springs 116 for each cutting structure 106, any number of springs 116 (e.g., one, two, or three or more springs) can be used to bias the cutting structure 106 toward the radially retracted position. For example, the example reamer assembly 100 can include one or more springs 116 for each cutting structure 106, and one or more or each cutting structure 106 can have the same or a different number of springs 116.

In the example reamer assembly 100 of FIGS. 3A through 4B, the expandable support element 114 has a sleeve-like shape in the internal cavity of the reamer body 104. However, the expandable support element 114 can take a variety of forms, different than the sleeve-like shape depicted in FIGS. 3A through 4B. The expandable support element may be a shaped layer, ball, and/or other single unit of material adjacent one or more of the cutting structures 106.

Figure 5B:
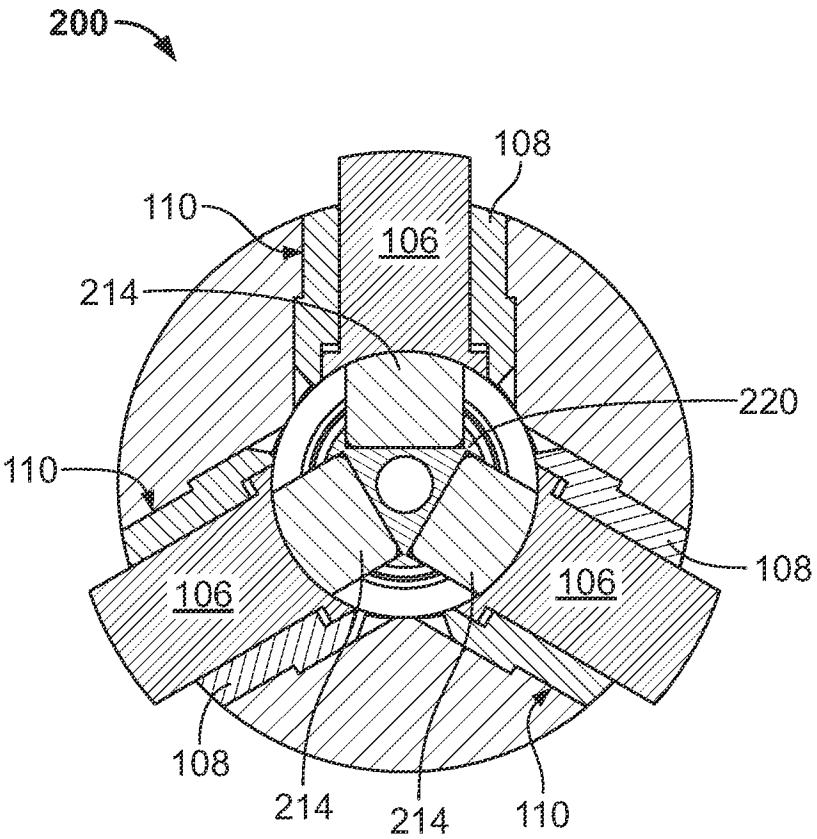
FIGS. 5A and 5B are schematic cross-sectional transverse views of a second example wellbore reamer assembly in an inactivated retracted position and an activated extended position, respectively.
Figure 5A:
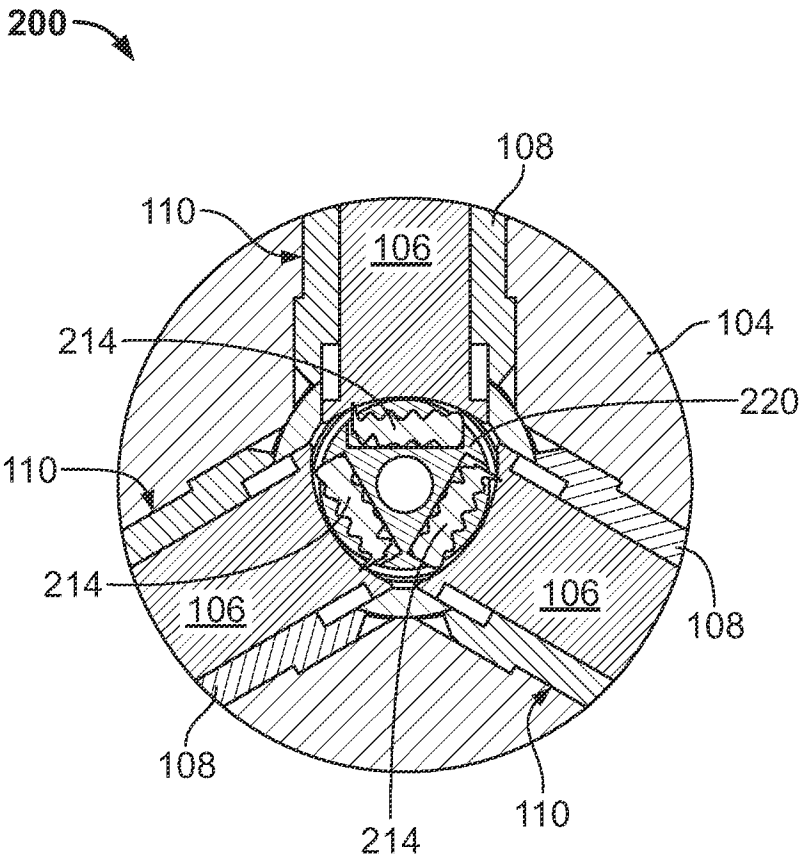
Figure 6:
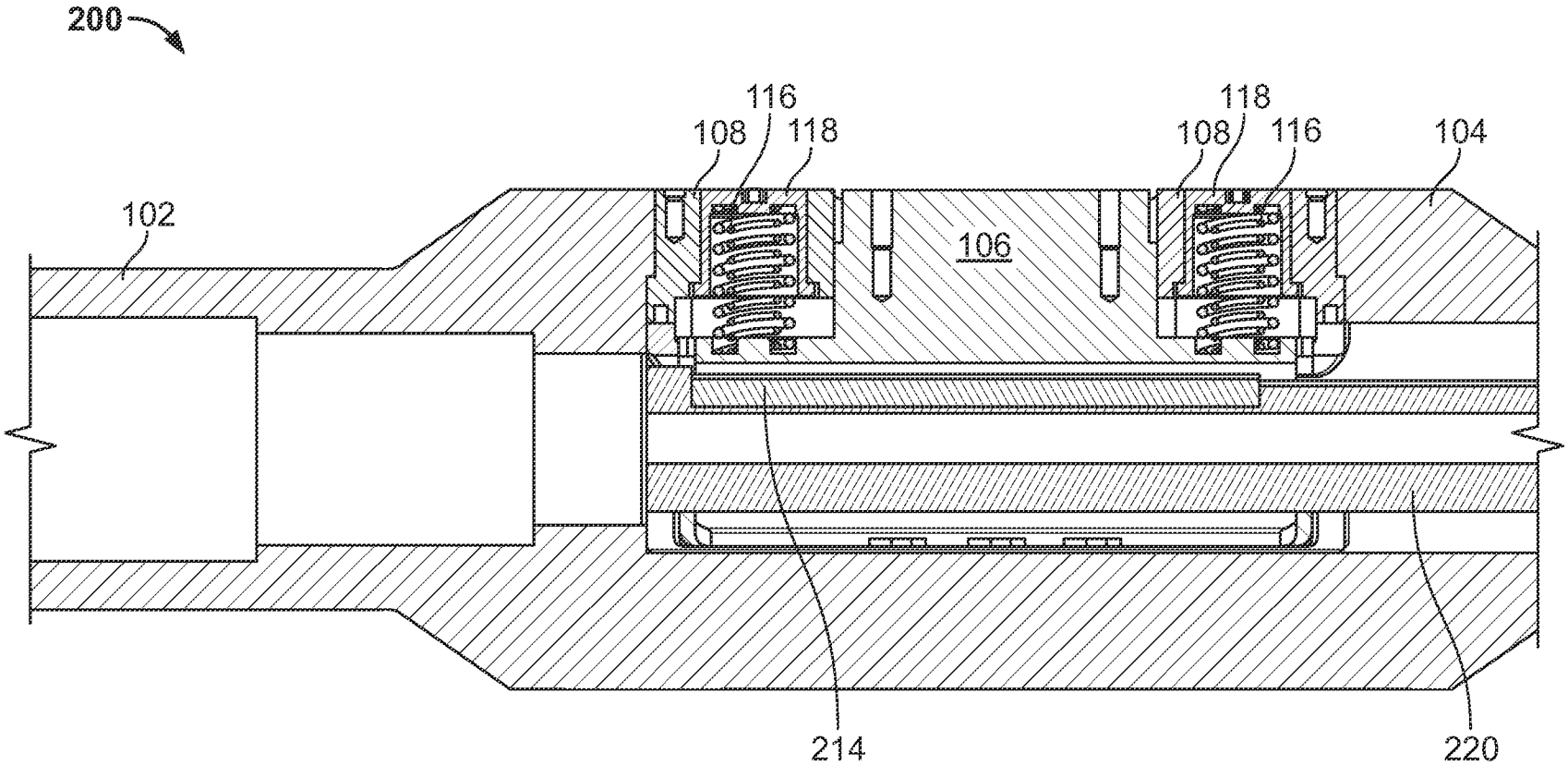
FIG. 6 is a schematic cross-sectional side view of the second example wellbore reamer assembly of FIG. 5A in an inactivated retracted position.

FIGS. 5A and 5B are schematic cross-sectional transverse views of a second example reamer assembly 200 similar to the example reamer assembly 100 of FIGS. 3A and 3B, except the expandable support elements 214 are generally rectangular shaped sheets or layers with an irregularly shaped periphery carried in a cylindrical support structure 220 in the internal cavity of the reamer body 104. The support structure 220 includes indents to hold the expandable support elements 214 adjacent the cutting structures 106. FIG. 6 is a schematic cross-sectional side view of the second example reamer assembly 200 corresponding to the radially retracted position of the cutting structure 106 depicted in FIG. 5A. The support structure 220 may include a central bore along the central axis A-A, for example, to allow fluid communication in the drill string 102 through the second example reamer assembly 200. The diameter of the bore in the support structure 220 can vary, for example, the bore diameter can be smaller or larger than depicted in FIGS. 5A, 5B, and 6. The cutting structures 106 and flanges 108 may be smaller in radial length to allow for a larger bore diameter of the support structure 220 for increased fluidic communication in the drill string 102 across the second example reamer assembly 200. If desired, the second example reamer assembly 200 may include one, two, or more than three expandable support elements 214, for example, one or more expandable support elements 214 for each cutting structure 106. Although FIGS. 5A and 5B show one expandable support element 214 for each cutting structure 106, any number of expandable support elements 214 can support any number of cutting structures 106. For example, the arrangement of cutting structures 106 to expandable support elements 214 can include one cutting structure 106 supported by two or more expandable support elements 214, one expandable support element 214 supporting two or more cutting structures 106, a combination of these arrangements, and/or other arrangement.

The reamer body 104 may include additional or different features than depicted in FIGS. 3A through 6. For example, the reamer body 104 can include multiple internal cavities connecting longitudinal ends of the reamer body 104. The reamer body 104 may include fluid passageways, sensors, and/or other components in the one or more internal cavities of the reamer body 104.

Figure 7B:
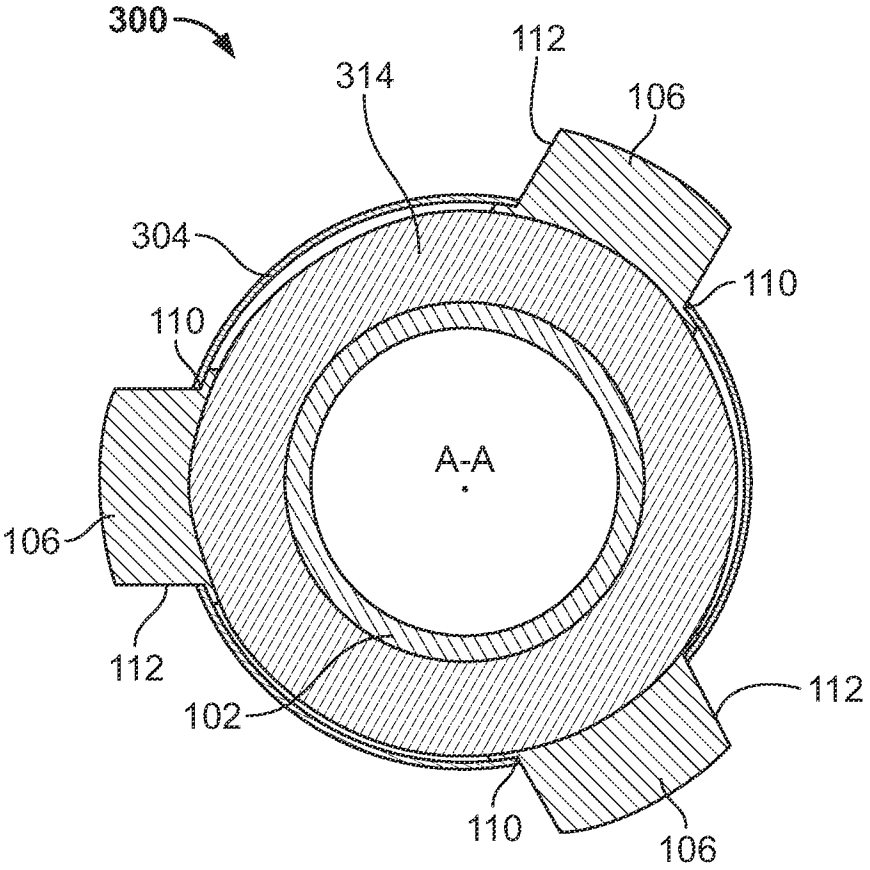
FIGS. 7A and 7B are schematic cross-sectional transverse views of a third example wellbore reamer assembly in an inactivated retracted position and an activated extended position, respectively.
Figure 7A:
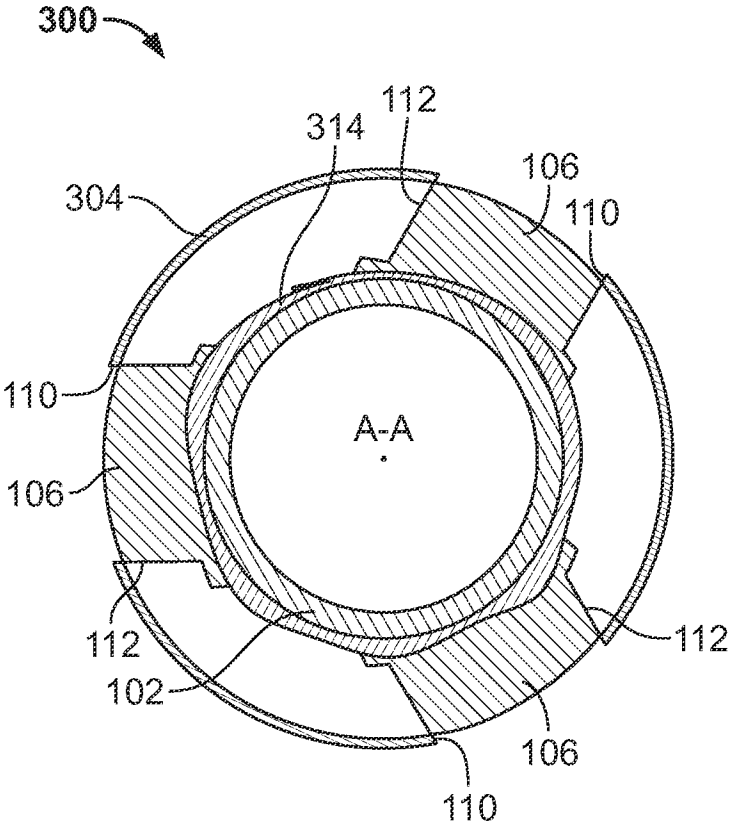

In the example reamer assembly 100 of FIGS. 3A through 4B, the reamer body 104 is integral to the drill string 102, for example, such that the reamer body is positioned on the drill string 102 as part of the drill string 102. The reamer body 104 is an extension of the drill string 102, where the reamer body 104 has a diameter equal to or larger than a diameter of adjacent portions of the drill string 102. This orientation is similar for the second example reamer assembly 200 of FIGS. 5A, 5B, and 6. However, the drill string 102 may extend through a reamer body, and components of a reamer assembly reside within the body exterior to the drill string 102. For example, FIGS. 7A and 7B are cross-sectional transverse views of a third example reamer assembly 300 similar to the example reamer assembly 100 of FIGS. 3A and 3B, respectively, except the drill string 102 extends through the reamer body 304 of the third example reamer assembly 300, and the third example reamer assembly 300 (optionally) excludes the flanges 108, springs 116, and spring caps 118 of the example reamer assembly 100 of FIGS. 3A through 4B. FIG. 7A shows the third example reamer assembly 300 with the cutting structures 106 in the radially retracted position, and FIG. 7B shows the third example reamer assembly 300 with the cutting structures 106 in the radially extended position. The fluid-activated expandable support element 314 has a sleeve-like shape about the drill string 102, such that activation and expansion of the expandable support element 314 applies radially outward force against the cutting structures 106 to move the cutting structures 106 through the openings 110 of the body 304 toward the radially extended position. Openings 110 of the body 304 allow the cutting structures 106 to move from the radially retracted position substantially within the internal cavity of the body 304 to the radially extended position substantially exterior to the body 304. The shapes of the openings 110 may substantially match shapes of the cutting structures 106.

Figure 8B:
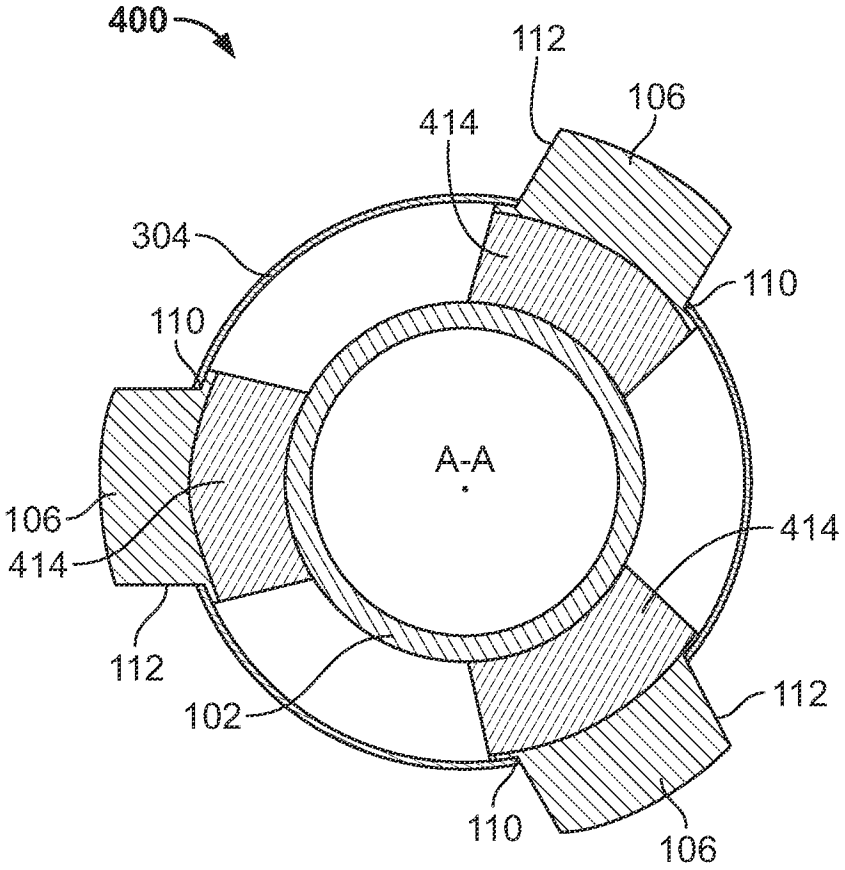
FIGS. 8A and 8B are schematic cross-sectional transverse views of a fourth example wellbore reamer assembly in an inactivated retracted position and an activated extended position, respectively.
Figure 8A:
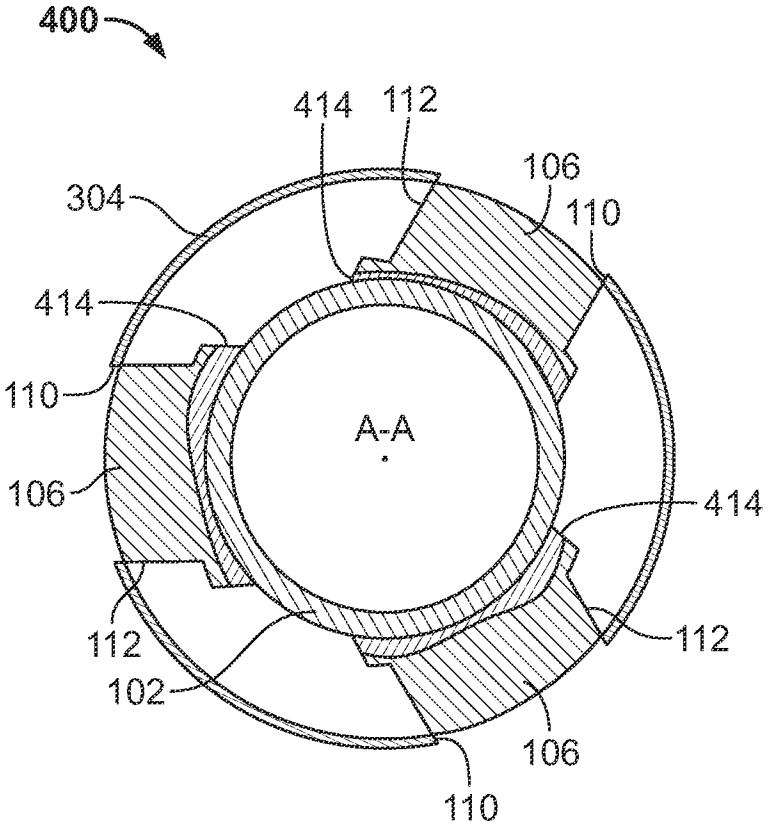

The expandable support element may be a shaped layer, ball, and/or other single unit of material between the drill string 102 and one or more of the cutting structures 106. For example, FIGS. 8A and 8B are cross-sectional transverse views of a fourth example reamer assembly 400 similar to the third example reamer assembly 300 of FIGS. 7A and 7B, respectively, except expandable support elements 414 of the fourth example reamer assembly 400 are rectangular shaped sheets or layers between the drill string 102 and cutting structures 106. The expandable support elements 212 may be irregularly shaped units between the drill string 102 and the cutting structures 106 with shapes that may or may not match shapes of the cutting structures 106.

An intermediate component may exist between the expandable support element and the one or more or each cutting structure. For example, the expandable support element can push against the intermediate component that is connected to and in contact with the one or more or each cutting structures while the support element activates and expands. If desired, the intermediate component may guide the one or more or each cutting structure from the radially retracted position through the opening(s) of the body to the radially extended position.

In view of the discussion above, certain aspects encompass a wellbore reamer assembly positionable on a drill string in a wellbore. The wellbore reamer assembly includes a reamer body having an internal cavity and a plurality of radial openings, a plurality of cutting structures each positioned in one of the plurality of radial openings in the reamer body, and a fluid-activated expandable support element positioned in the internal cavity of the reamer body adjacent the plurality of cutting structures. The cutting structures are extendable radially away from a central longitudinal axis of the reamer body through respective radial openings in the reamer body and retractable toward the central longitudinal axis of the reamer body. The expandable support element is adapted to extend the cutting structures radially away from the central longitudinal axis of the reamer body.

Certain aspects encompass a method of enlarging a wellbore diameter including positioning in the wellbore a drill string including a wellbore reamer assembly attached thereto. The wellbore reamer assembly includes a reamer body having an internal cavity and a plurality of radial openings, a plurality of cutting structures positioned in one of the plurality of radial openings in the reamer body, and a fluid activated expandable support element positioned in the internal cavity of the reamer body adjacent the plurality of cutting structures. The cutting structures are extendable radially away from a central longitudinal axis of the reamer body through respective radial openings in the reamer body, the cutting structures including at least one cutting element. The method includes contacting radially inward ends of the plurality of cutting structures with the expandable support element, activating the wellbore reamer assembly by expanding the fluid-activated expandable support element, moving the plurality of cutting structures from a radially retracted position to a radially extended position, and engaging a radial wall of the wellbore with radially outward ends of the cutting structures radially extended.

Certain aspects encompass a wellbore reamer including a plurality of cutting structures carried on a reamer body and coupled to an expandable support element adapted to expand and move the cutting structures through one or more openings in the reamer body from a radially retracted position to a radially extended position. The expandable support element includes an inflatable bladder that expands by fluid supplied to the bladder. The plurality of cutting structures in the radially extended position are adapted to engage radial walls of a wellbore to widen a diameter of the wellbore.

The aspects above can include some, none, or all of the following features. The expandable support element includes an inflatable bladder that expands by fluid supplied to the bladder to move the cutting structures from a radially retracted position to a radially extended position. Each cutting structure in the plurality of cutting structures includes a cutting element at a radially outward end of the cutting structure. The expandable support element is positioned adjacent a radially inward end of the cutting structure opposite the cutting element. The wellbore reamer assembly includes a support structure in the internal cavity of the reamer body and a plurality of fluid-activated expandable support elements, the support structure to hold the plurality of expandable support elements adjacent the plurality of cutting structures. The expandable support element includes a swellable material which swells upon contact with fluid including an activation component carried in the fluid provided to the internal cavity of the reamer body. The plurality of cutting structures includes a plurality of cutter blocks, each cutter block comprising a cutting edge. The cutting structures include a blade with individual cutters affixed to the blade. The cutting structures include cutters affixed to a roller disc. The cutting structures include cutting teeth affixed to a roller cone. The wellbore reamer assembly includes one, two, three, or four cutting structures spaced about the reamer body. The wellbore reamer assembly includes one or more springs to bias the cutting structures toward the radially retracted position. Activating the wellbore reamer assembly by expanding the expandable support element includes inflating the expandable support element with a fluid provided to the expandable support element. Inflating the support element with a fluid provided to the expandable support element includes opening a flow port in the reamer body to allow fluid to be provided to the expandable support element. The method includes rotating the drill string with the cutting structures of the wellbore reamer assembly in the radially extended position. The method includes moving the drill string and wellbore reamer assembly longitudinally in the wellbore while rotating the drill string with the cutting structures of the wellbore reamer assembly in the radially extended position. Activating the wellbore reamer assembly by expanding the support element includes introducing fluid to the expandable support element to expand the expandable support element and substantially fill the internal cavity of the reamer body of the reamer assembly. Activating the wellbore reamer assembly by expanding the expandable support element includes contacting and swelling the expandable support element with an activation component carried in a fluid provided to the internal cavity of the reamer body. Activating the wellbore reamer assembly by expanding the expandable support element includes activating an activation sensor of the wellbore reamer assembly with an activation component carried in a fluid through the wellbore reamer assembly to expand the expandable support element. The method includes sealing a space between the at least one opening in the reamer body and the cutting structures in a radially extended position with the expandable support element. The expandable support element is adapted to seal the one or more openings in the reamer body with the cutting structures in the radially extended position. The cutting structures include cutter blocks and the one or more openings in the reamer body substantially match a shape of the cutter blocks.

The methods, assemblies, and systems of the present disclosure may also encompass the following aspects. Certain aspects encompass a wellbore reamer includes a plurality of cutting structures carried on a reamer body and coupled to a fluid-activated expandable support element adapted to expand and move the cutting structures through one or more openings in the reamer body from a radially retracted position to a radially extended position.

The aspects above can include some, none, or all of the following features. The wellbore reamer assembly is positionable on a drill string in a wellbore, the wellbore reamer assembly including a reamer body having an internal cavity and a plurality of radial openings, a plurality of cutting structures each positioned in one of the plurality of radial openings in the reamer body, the cutting structures extendable radially away from a central longitudinal axis of the reamer body through respective radial openings in the reamer body and retractable toward the central longitudinal axis of the reamer body, and a fluid-activated expandable support element positioned in the internal cavity of the reamer body adjacent the plurality of cutting structures, the expandable support element adapted to extend the cutting structures radially away from the central longitudinal axis of the reamer body. The expandable support element includes an inflatable bladder that expands by fluid supplied to the bladder to move the cutting structures from a radially retracted position to a radially extended position. Each cutting structure in the plurality of cutting structures includes a cutting element at a radially outward end of the cutting structure. The expandable support element is positioned adjacent a radially inward end of the cutting structure opposite the cutting element. The wellbore reamer assembly includes a support structure in the internal cavity of the reamer body and a plurality of fluid-activated expandable support elements, the support structure adapted to hold the plurality of expandable support elements adjacent the plurality of cutting structures. The expandable support element includes a swellable material which swells upon contact with fluid including an activation component carried in the fluid provided to the internal cavity of the reamer body. The plurality of cutting structures includes a plurality of cutter blocks, each cutter block comprising a cutting edge. The wellbore reamer assembly includes a plurality of cutting structures carried on a reamer body and coupled to an expandable support element adapted to expand and move the cutting structures through one or more openings in the reamer body from a radially retracted position to a radially extended position, where the expandable support element includes an inflatable bladder that expands by fluid supplied to the bladder, and where the plurality of cutting structures in the radially extended position are adapted to engage radial walls of a wellbore to widen a diameter of the wellbore. The expandable support element is adapted to seal the one or more openings in the reamer body with the cutting structures in the radially extended position. The cutting structures comprise cutter blocks and the one or more openings in the reamer body substantially match a shape of the cutter blocks. The cutting structures include a blade with individual cutters affixed to the blade. The cutting structures include cutters and/or cutting teeth affixed to a roller disc and/or roller cone. The wellbore reamer assembly includes one, two, three, or four cutting structures spaced about the reamer body. The wellbore reamer assembly includes one or more springs to bias the cutting structures toward the radially retracted position.

Certain aspects encompass a method of enlarging a wellbore diameter. The method includes positioning in the wellbore a drill string including a wellbore reamer assembly attached thereto. The wellbore reamer assembly includes a reamer body having an internal cavity and a plurality of radial openings, a plurality of cutting structures positioned in one of the plurality of radial openings in the reamer body, the cutting structures extendable radially away from a central longitudinal axis of the reamer body through respective radial openings in the reamer body and retractable toward the central longitudinal axis of the reamer body, said cutting structure including at least one cutting element, and a fluid-activated expandable support element positioned in the internal cavity of the reamer body adjacent the plurality of cutting structures. The method includes contacting radially inward ends of the plurality of cutting structures with the expandable support element, activating the wellbore reamer assembly by expanding the fluid-activated expandable support element, moving the plurality of cutting structures from a radially retracted position to a radially extended position, and engaging a radial wall of the wellbore with radially outward ends of the cutting structures radially extended.

The aspects above can include some, none, or all of the following features. Activating the wellbore reamer assembly by expanding the expandable support element includes inflating the expandable support element with a fluid provided to the expandable support element. Inflating the support element with a fluid provided to the expandable support element includes opening a flow port in the reamer body to allow fluid to be provided to the expandable support element. The method includes rotating the drill string with the cutting structures of the wellbore reamer assembly in the radially extended position. The method includes moving the drill string and wellbore reamer assembly longitudinally in the wellbore while rotating the drill string with the cutting structures of the wellbore reamer assembly in the radially extended position. Activating the wellbore reamer assembly by expanding the support element includes introducing fluid to the expandable support element to expand the expandable support element and substantially fill the internal cavity of the reamer body of the reamer assembly. Activating the wellbore reamer assembly by expanding the expandable support element includes contacting and swelling the expandable support element with an activation component carried in a fluid provided to the internal cavity of the reamer body. Activating the wellbore reamer assembly by expanding the expandable support element includes activating an activation sensor of the wellbore reamer assembly with an activation component carried in a fluid through the wellbore reamer assembly to expand the expandable support element. The method includes sealing a space between the at least one opening in the reamer body and the cutting structures in a radially extended position with the expandable support element. The cutting structures include a blade with individual cutters affixed to the blade. The cutting structures include cutters and/or cutting teeth affixed to a rotating disc and/or cone. The reamer assembly includes one, two, three, or four cutting structures spaced about the reamer body. The reamer assembly includes one or more springs to bias the cutting structures toward the radially retracted position.

A number of examples have been described. Nevertheless, it will be understood that various modifications may be made. Accordingly, other examples are within the scope of the following claims.

What is claimed is:

1. A wellbore reamer assembly positionable on a drill string in a wellbore, said wellbore reamer assembly comprising:

a reamer body having an internal cavity and a plurality of radial openings;

a plurality of cutting structures each positioned in one of the plurality of radial openings in the reamer body, the cutting structures extendable radially away from a central longitudinal axis of the reamer body through respective radial openings in the reamer body and retractable toward the central longitudinal axis of the reamer body; and a fluid-activated expandable support element positioned in the internal cavity of the reamer body adjacent the plurality of cutting structures, said expandable support element adapted to extend the cutting structures radially away from the central longitudinal axis of the reamer body and outward through the plurality of radial openings in the reamer body without the expandable support element extending beyond the reamer body, and further wherein the fluid-activated expandable support element is adapted to seal the one or more radial openings in the reamer body with the plurality of cutting structures in the radially extended position.

2. The wellbore reamer assembly of claim 1, wherein the expandable support element comprises an inflatable bladder that expands by fluid supplied to the bladder to move the cutting structures from a radially retracted position to a radially extended position.

3. The wellbore reamer assembly of claim 1, wherein the cutting structures comprise a blade with individual cutters affixed to the blade.

4. The wellbore reamer assembly of claim 1, wherein the cutting structures comprise cutters affixed to a roller disc.

5. The wellbore reamer assembly of claim 1, wherein the cutting structures comprise cutting teeth affixed to a roller cone.

6. The wellbore reamer assembly of claim 1, comprising one, two, three, or four cutting structures spaced about the reamer body.

7. The wellbore reamer assembly of claim 1, further comprising one or more springs to bias the cutting structures toward the radially retracted position.

8. A method of enlarging a wellbore diameter, the method comprising:

positioning in the wellbore a drill string including a wellbore reamer assembly attached thereto, said wellbore reamer assembly including:

a reamer body having an internal cavity and a plurality of radial openings;

a plurality of cutting structures positioned in one of the plurality of radial openings in the reamer body, the cutting structures extendable radially away from a central longitudinal axis of the reamer body through respective radial openings in the reamer body and retractable toward the central longitudinal axis of the reamer body, said cutting structure including at least one cutting element; and a fluid-activated expandable support element positioned in the internal cavity of the reamer body adjacent the plurality of cutting structures;

contacting radially inward ends of the plurality of cutting structures with the expandable support element;

activating the wellbore reamer assembly by expanding the fluid-activated expandable support element;

moving the plurality of cutting structures from a radially retracted position to a radially extended position with the expandable support element, without the expandable support element extending beyond the reamer body, and further wherein the expandable support element seals the one or more openings in the reamer body with the cutting structures in the radially extended position; and engaging a radial wall of the wellbore with radially outward ends of the cutting structures radially extended.

9. The method of claim 8, wherein activating the wellbore reamer assembly by expanding the expandable support element includes inflating the expandable support element with a fluid provided to the expandable support element.

10. The method of claim 9, wherein inflating the support element with a fluid provided to the expandable support element includes opening a flow port in the reamer body to allow fluid to be provided to the expandable support element.

11. The method of claim 8, wherein the cutting structures comprise a blade with individual cutters affixed to the blade.

12. The method of claim 8, wherein the cutting structures comprise cutters affixed to a roller disc.

13. The method of claim 8, wherein the cutting structures comprise cutting teeth affixed to a roller cone.

14. The method of claim 8, wherein the wellbore reamer assembly comprises one, two, three or four cutting structures spaced about the reamer body.

15. The method of claim 8, wherein the wellbore reamer assembly comprises one or more springs to bias the cutting structures toward the radially retracted position.

16. A wellbore reamer, comprising:

a plurality of cutting structures carried on a reamer body and coupled to an expandable support element adapted to expand and move the cutting structures through one or more openings in the reamer body from a radially retracted position to a radially extended position without the expandable support element extending beyond the reamer body;

wherein the expandable support element comprises an inflatable bladder that expands by fluid supplied to the bladder; and wherein the plurality of cutting structures in the radially extended position are adapted to engage radial walls of a wellbore to widen a diameter of the wellbore, and further wherein the expandable support element is adapted to seal the one or more openings in the reamer body with the cutting structures in the radially extended position.

17. The wellbore reamer of claim 16, wherein the cutting structures comprise cutter blocks and the one or more openings in the reamer body substantially match a shape of the cutter blocks.

18. The wellbore reamer of claim 16, wherein the cutting structures comprise a blade with individual cutters affixed to the blade.

19. The wellbore reamer of claim 16, further comprising one or more springs to bias the cutting structures toward the radially retracted position.

* * * * *